US007071801B2

(12) United States Patent
Yamazaki et al.

(10) Patent No.: US 7,071,801 B2
(45) Date of Patent: Jul. 4, 2006

(54) COMPARTMENTALIZED MAGNET DEVICE

(75) Inventors: Nobuyuki Yamazaki, Tokyo (JP); Hisae Yamashita, Tokyo (JP)

(73) Assignee: Design Factory Inc., Tokyo (JP)

( * ) Notice: Subject to any disclaimer, the term of this patent is extended or adjusted under 35 U.S.C. 154(b) by 0 days.

(21) Appl. No.: 10/642,312

(22) Filed: Aug. 15, 2003

(65) Prior Publication Data

US 2005/0035837 A1 Feb. 17, 2005

(51) Int. Cl.
*H01F 7/02* (2006.01)

(52) U.S. Cl. ..... 335/306; 335/302

(58) Field of Classification Search ..... 335/205–207, 335/302–306

See application file for complete search history.

(56) References Cited

U.S. PATENT DOCUMENTS 2,570,625 A * 10/1951 Zimmerman et al. ..... 446/92
3,254,440 A * 6/1966 Duggar ..... 446/92
4,741,534 A 5/1988 Rogahn
5,347,253 A 9/1994 Ogikubo
5,409,236 A * 4/1995 Therrien ..... 273/288
6,024,626 A * 2/2000 Mendelsohn ..... 446/92
6,302,363 B1 * 10/2001 Olson et al. ..... 248/206.5
6,400,247 B1 * 6/2002 King ..... 335/302
6,508,904 B1 * 1/2003 Charley ..... 156/249

* cited by examiner

*Primary Examiner*—Elvin G. Enad
*Assistant Examiner*—Bernard Rojas
(74) *Attorney, Agent, or Firm*—Dilworth & Barrese LLP

(57) ABSTRACT

Disclosed herein is a polyhedron magnet device for attaching to magnetically attractive surfaces and holding items. The device includes a plurality of sidewalls extending in a longitudinal direction along the surface of the device, partitions, and end walls, which are placed perpendicularly to sidewalls to form one or more magnet holding chambers and separation chambers.

22 Claims, 2 Drawing Sheets

COMPARTMENTALIZED MAGNET DEVICE

BACKGROUND OF THE INVENTION

1. Field of the Invention

This invention relates generally to decorative magnets, and more particularly to a multi-magnet novelty device capable of carrying signs, advertisement displays, and interchangeable displays, on all of the device's multiple surfaces.

2. Description of the Related Art

The prior art includes devices that employ magnets arranged inside structures. For example, U.S. Pat. No. 5,347,253 discloses a block that includes a magnet body inside. U.S. Pat. No. 4,741,534 discloses a block that includes a metal ball inside, that ball being attracted to magnetic objects. Furthermore, it is known, for example, to provide "refrigerator" magnets to secure pieces of paper to a metal surface.

While prior art arrangements have fulfilled their intended roles and functions in a more or less satisfactory manner, they have been less than desirable insofar as their ability to be utilized as miniature, multi-sided, decorative magnet devices for connecting to magnetically attractive surfaces.

SUMMARY OF THE INVENTION

It is an object of the present invention to provide an improved miniature, multi-sided, decorative magnet device.

It is a further object of the present invention to provide an improved miniature, multi-sided, decorative magnet device of novel construction for use as a paperweight.

Still a further object of the present invention is to provide a decorative magnet device in the form of a polyhedron that includes at least one variably shaped magnet.

A polyhedron magnet device is provided for attaching to magnetically attractive surfaces and holding items. The device comprises a plurality of sidewalls extending in a longitudinal direction along the surface of the device, partitions, and end walls, which are placed perpendicularly to the sidewalls to form one or more magnet holding chambers and separation chambers. Magnets are placed into the magnet holding chambers. The separation chamber maintains magnetic interaction between magnets in separated magnet holding chambers. Advertising banners may be connected to the sidewalls and end walls by printing, adhesive substances, and magnetically attracting. It is the magnets that create the magnetic attraction.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENT

Figure 1:
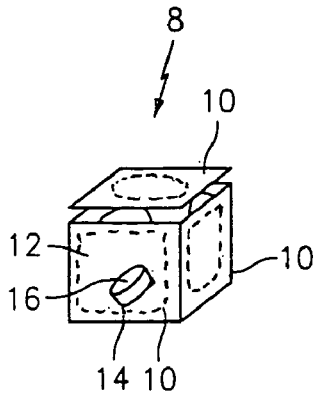
FIG. 1 is a perspective view of a single magnet device in accordance with the present invention.

Referring to FIG. 1, there is shown a polyhedron magnet device 8. The exemplary device of FIG. 1 is of a rectangular or cube shape and includes a flat magnet inside. Each of device's six sides 10 can be used to display signs or pictures. Those signs or pictures can be painted or glued to the surface of each of the sides 10. Similarly, interchangeable magnetically attractive sign or picture plates, made of magnetic or magnetically attracted material, can be connected to the sides of the inventive device. Because of its magnetic nature, the inventive device 8 can be used for display purposes or to hold papers, photographs, and other thin items against any magnetically attracted surface, for example a refrigerator or a clipboard.

In the present example, the inventive device is formed of light transparent material such as plastic, however, other materials that are not magnetically attractive may be used. The inventive magnet device 8 includes a chamber 12 for holding a magnet 14. The magnet 14 must possess a sufficient magnetic force to attract magnetic or magnetically attractive sign plates to sides of the magnet device or hold the device affixed to a magnetically attractive surface in horizontal and vertical positions.

The magnet 14 is allowed to move freely inside the chamber 12, so that any side 10 of the device 8 may be attached to a surface. The chamber 12 may be of any shape, e.g., oval, circular, rectangular, that enables free movement of the magnet 12 inside the chamber. Similarly, the magnet 14 may be of any shape. Preferably, the shape of the magnet 14 enables it to move its widest surface 16 closer to a side 10 of the device 8 that requires magnetic attraction force. For example, the magnet can be flat circular, flat rectangular, cube, and rectangular.

In the preferred embodiment, the chamber 12 is rectangular in shape, with rounded corners. Walls of the chamber 12 are flat and the rounded corners transition between walls. The magnet 14 is flat or pancake shaped, able to fully rotate inside the chamber 12. The flat shape and size of the exemplary magnet 14 should allow it to use its largest surface area 16 to fully align with a side 10 within the chamber 12 to interact with any magnetically attractive surface using its full magnetic force. The rounded corners of the chamber 12 prevent the magnet 14 from being wedged in the corner and the flat walls allow the magnet 14 to come to direct contact with each wall.

Figure 2A:
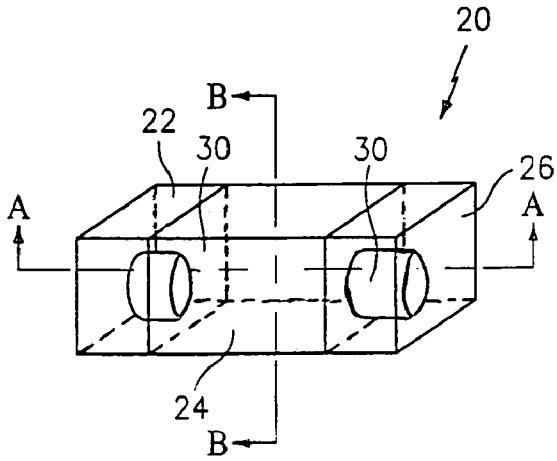
FIG. 2*a* is a perspective view of a multiple magnet device in accordance with the present invention.

In another embodiment of the present invention, illustrated in FIG. 2*a*, the inventive device 20 includes three chambers 22, 24, and 26. Two chambers 22 and 26 are used to hold magnets 30. The separating chamber 24 is used to maintain a constant distance between magnets 30. The separation distance or the size of the separation chamber 24 is sufficient to maintain magnetic interaction between magnets 30 in chambers 22 and 26. Various items, solids, liquids, and gasses, may be placed into the separation chamber for observation by a user. It is preferred that such items are non-magnetically attractive, however, magnetically attracted items may also be used.

Figure 2B:
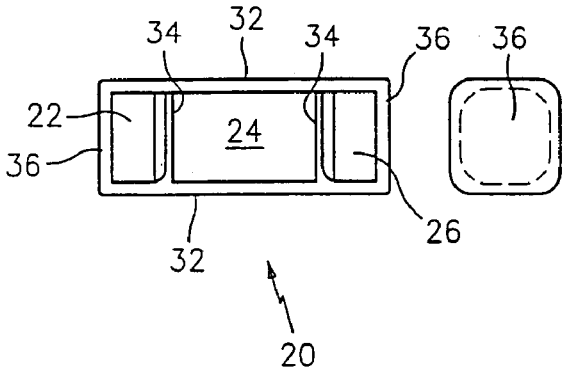
FIG. 2*b* is a top view of the multiple magnet device of the present invention illustrated in FIG. 2*a;*

FIG. 2*b* is a top view of the device shown in FIG. 2*a*. The inventive device is shown to comprise long sidewalls 32, two partitions 34 and two end walls 36. Partitions 34 are made in such a manner as to form a rounded angle with long sidewalls 32 around its edge on the side facing the end wall 36 in chambers 22 and 26. The radius of the formation may be, for example, two millimeters, as shown in the example of FIG. 2*b*. Similarly, the radius of the area of contact between the end wall 36 and the long sidewalls 32 may be 0.5 centimeters. The reason for the above-described curvature is to prevent magnets 30 from being wedged in areas of contact between end walls 36, long sidewalls 32 and partitions 34.

To further assure that the magnetic force of magnets 30 is fully utilized, in one embodiment the present invention uses flat or pancake shaped magnets 30 (see FIG. 2*a*). A flat magnet will always use its widest area, and therefore its maximum strength, to interact with other magnetically attractive objects.

A shape of the end walls 36 defines a cross section of the inventive device 20. In the embodiment illustrated in FIG. 2*b*, the end walls 36 are of a rectangular shape. This, therefore, dictates that the number and/or shape of long sidewalls 32 is four. In other embodiments of the present invention, end walls 36 may be shaped like a triangle, tetragon, circle, oval, square, rectangle, pentagon, hexagon, star, or any other shape, thereby defining the shape of the cross section of the device 20. In addition to varying shape, the device 20 and the chambers 22, 24, and 26 can be made of varying sizes.

Figure 2C:
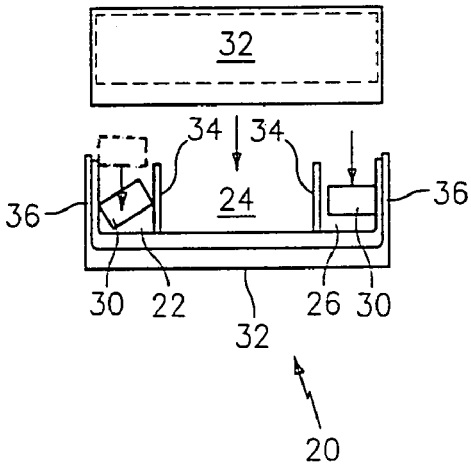
FIG. 2*c* is a side view of the multiple magnet device of the present invention illustrated in FIG. 2*a;*

FIG. 2*c* is a side and cutaway view of the device shown in FIG. 2*a*. FIG. 2*c* illustrates one possible manner of manufacturing of the inventive device. Here, for a rectangular device, three long sidewalls 32 are assembled with two partitions 34 and two end walls 36 to create receptacles for two magnets 30. The fourth long sidewall 32 covers the remaining opening above chambers 22, 24, and 26 to seal the magnets 30 and complete the device.

Figure 3A:
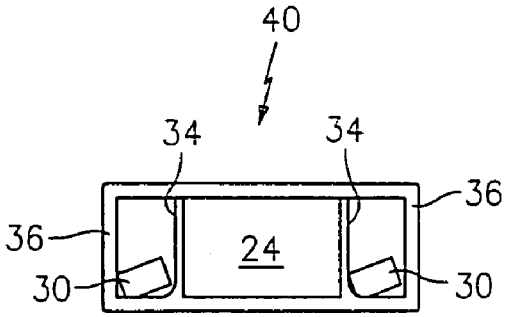
FIG. 3*a* is a cross-sectional view of the multiple magnet device illustrated in FIG. 2*a*, taken along lines A—A.

As can be seen in FIG. 3*a*, a cross-sectional view of the device 40, which may be made of cardboard, plastic, or other suitable material, taken along lines A—A of FIG. 2*a*. The ratio of a length of the interior separation chamber 24 to the length of the device 40 is about 54%. The ratio of a length of each of the magnet holding chambers 22 and 26 is about 23%. The above-described ratios are calculated to position magnets in such distance to each other as to promote interaction, which is the magnetic attraction between magnets 30.

Figure 3B:
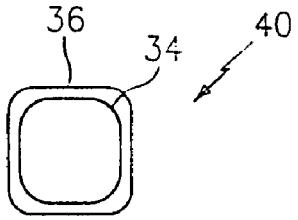
FIG. 3*b* is a cross-sectional view of the multiple magnet device illustrated in FIG. 2*a*, taken along lines B—B.

FIG. 3*b* illustrates a cross-sectional view of the device 40 taken along lines B—B of FIG. 2*a*. Here, the end wall 36 is in proportion of about 40% to the length of the device 40, the outside corner radius is in proportion of about 6% and the inside rounded corner radius is in proportion of 8% to the length of the device 40.

The above described device constructed as described above will allow flat magnets 30 to rotate within chambers 22 and 26 in such a manner that both the magnets are attracted to each other by the mutual magnetic force and held back only by partitions 34 on respective sides of the chambers 24 and 26 when the device 40 is moved, shaken, or rotated. When the device 40 is allowed to approach a magnetically attractive surface, magnets 30 change direction of their position within respective chambers 22 and 26 by 90 degree so as to contact, in a parallel relation with the contact surface, to the magnetically attractive surface. The easy movement of magnets 30 is enabled by the curvature of the edge of partitions 34.

Figure 4A:
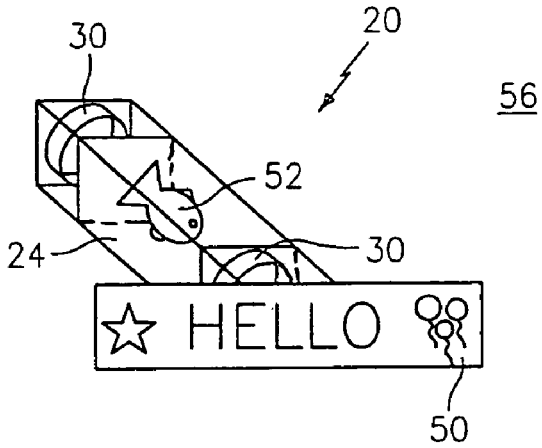
FIGS. 4*a, b*, and *c* are perspective views of a multi-magnet device in use in accordance with the present invention.
Figure 4B:
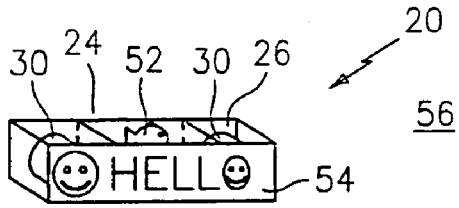
Figure 4C:
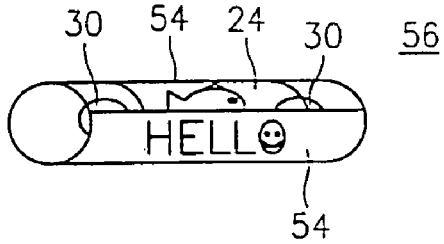

The above described inventive device and its variations can be used as a paperweight or paper holder, a refrigerator magnet, and an advertising device, wherein copies for advertisement are connected to each surface of the main body. FIGS. 4*a–c* show the inventive device 20 in use, connected to a magnetically attractive surface 56. A magnetic banner 50 is connected to the device 20 in one embodiment, and a sign 54 is painted or glued to the device 20 in another embodiment. Furthermore, a novelty item 52 is placed into the separation chamber 24 for viewing or for making sounds.

The above description is given by way of example only. Changes in form and details may be made by one skilled in the art without departing from the scope of the invention as defined by the appended claims.

What is claimed is:

1. A magnet device (20) for attaching to magnetically attractive surfaces and holding items therebetween, the device (20) comprising:

a plurality of walls forming a plurality of chambers (22, 24, 26) enclosed therein;

at least one (22, 26) of said chambers (22, 24, 26) having a magnet (30) freely movably enclosed therein to both rotatably and translationally move within said chamber (22, 26) and turn about two separate axes and abut any internal wall of said chamber (22, 26) when brought close to a magnetically attractive surface; and at least one other chamber (24) is empty and located next to said magnet (30) holding chamber (22, 26).

2. The device of claim 1, wherein said chambers have a cross-sectional shape selected from one of oval and circle.

3. The device of claim 1, wherein said chambers have a polyhedron cross-sectional shape selected from one of a triangle, tetragon, pentagon, rectangle, square, star, and hexagon.

4. The device of claim 1, further comprising images covering one portion of at least one of said walls.

5. The device of claim 4, wherein said images are one of letters, graphics, or a combination of letters and graphics.

6. The device of claim 5, wherein said images are used for advertisement.

7. The device of claim 5, wherein said images are secured to said walls by printing on said walls, printing on adhesive paper or film for connecting to said walls, and printing on a magnetically attractive substance for connecting to said sides wherein said magnets attract said magnetically attractive substance.

8. The device of claim 7, wherein said images extend in a longitudinal direction along a surface of said walls.

9. The device of claim 1, wherein said magnet has a shape selected from one of a circular disk, cube, and rectangular parallelepiped.

10. A polyhedron magnet device (20) for attaching to magnetically attractive surfaces and holding items therebetween, the device (20) comprising:

a plurality of sidewalls (32) extending in a longitudinal direction, and partitions (34) and end walls (36) placed perpendicularly to said sidewalls (32) for forming a plurality of chambers (22, 24, 26), said chambers (22, 24, 26) defining a plurality of magnet holding chambers (22, 26) and at least one separation chamber (24) between said magnet holding chambers (22, 26); and one or more magnets (30) movably enclosed in each of said magnet holding chambers (22, 26) to both rotatably and translationally move within said respective chamber (22, 26) and turn about two separate axes and abut any internal wall of said respective magnet-holding chamber (22, 26) when brought close to a magnetically attractive surface, wherein said separation chamber (24) does not contain a magnet and maintains magnetic interaction between said magnets (30) in said magnet holding chambers (22, 26).

11. The device of claim 10, further comprising banners connected to at least one of sidewalls and end walls, said banners being connected by one of printing, adhesive substance, and magnetically attractive, wherein said magnets attract said magnetically attractive substance.

12. The device of claim 11, wherein said separation chamber includes a non-magnetically attractive substance.

13. A magnet device (8) for attaching to magnetically attractive surfaces and holding items therebetween, the device (8) comprising:

a plurality of walls (10) defining an interior chamber (12); and a magnet (14) enclosed within said chamber (12), wherein interior corners of said walls (10) defining said chamber (12) are rounded to smoothly transition between flat surfaces of adjacent walls (10) to prevent the magnet (14) from being wedged in areas of contact between said walls (10) and permit free rotational and translational movement and rotation about two separate axes of said magnet (14) within said chamber (12) to abut any internal wall of said chamber (12).

14. The device of claim 13, wherein the magnet has a shape selected from one of a circular disk, cube, and rectangular parallelepiped.

15. The device of claim 13, wherein said magnet is freely movably enclosed in said magnet holding chamber to abut any internal wall of said chamber when brought close to a magnetically attractive surface.

16. The device of claim 13, wherein radius of curvature between partition walls and side walls is approximately 2 mm and between end walls and the side walls approximately 0.5 mm.

17. The device of claim 10, wherein ratio of length of said separation chamber to said entire device is approximately 54% and of each said magnetic holding chamber to said entire device approximately 23%.

18. The device of claim 13, wherein an end wall is in proportion of about 40%, an outside corner radius in proportion of about 6% and inside corner radius in proportion of about 8% to length of the device.

19. The device of claim 1, comprising two said magnet holding chambers each containing a magnet, with said separation chamber positioned therebetween such that both magnets are mutually attracted to each other and held back only by said intermediately-positioned separation chamber when said device is moved, rotated or shaken, and when said device is brought close to a magnetically-attractive surface, said magnets reorient approximately 90° and are attracted, in tandem, to the same internal wall of said device facing the magnetically-attractive surface.

20. The device of claim 10, comprising two said magnet holding chambers each containing a magnet, with said separation chamber positioned therebetween such that both magnets are mutually attracted to each other and held back only by said intermediately-positioned separation chamber when said device is moved, rotated or shaken, and when said device is brought close to a magnetically-attractive surface, said magnets reorient approximately 90° and are attracted, in tandem, to the same internal wall of said device facing the magnetically-attractive surface.

21. The device (20) of claim 1 in the shape of a rectangular parallelepiped or cylinder and having two said magnet-holding chambers (22, 26) at opposite longitudinal ends thereof, said empty-chamber (24) being located between said magnet-holding chambers (22, 26) in a longitudinal direction, and an outer wall (32) of both said magnet-holding chambers (22, 26) and intermediate, empty chamber (24) forming a continuous flat surface in the shape of the rectangular parallelepiped or radially-curved surface in the shape of the cylinder.

22. The device (20) of claim 10 in the shape of a rectangular parallelipiped or cylinder and having two said magnet-holding chambers (22, 26) at opposite longitudinal ends thereof, said separation chamber (24) located between said magnet-holding chambers (22, 26), and an outer wall (32) of both said magnet-holding chambers (22, 26) and separation chamber (24) forming a continuous flat surface in the shape of the rectangular parallelepiped or radially-curved surface in the shape of the cylinder.

* * * * *